US006134187A

United States Patent [19]

Tomiyasu

[11] Patent Number: 6,134,187

[45] Date of Patent: Oct. 17, 2000

[54] REAL-TIME CLOCK DEVICE SUITABLE FOR PORTABLE COMPUTER HAVING AUTO POWER-ON FUNCTION

[75] Inventor: Yuichi Tomiyasu, Tokyo, Japan

[73] Assignee: Kabushiki Kaisha Toshiba, Kawasaki, Japan

[21] Appl. No.: 08/937,806

[22] Filed: Sep. 25, 1997

[30] Foreign Application Priority Data

Sep. 30, 1996 [JP] Japan ..... 8-279025

[51] Int. Cl.[7] ..... G04B 19/24; G04B 23/02; G04F 1/00

[52] U.S. Cl. ..... 368/28; 368/73; 702/178; 711/5

[58] Field of Search ..... 368/10, 28, 29, 368/156–157; 364/569, 705–708; 395/551, 557; 577/15, 20, 26, 32, 44; 702/178; 711/5

[56] References Cited

U.S. PATENT DOCUMENTS 5,422,862 6/1995 Wisor .

5,487,096 1/1996 Pearson et al. ..... 377/15

5,829,008 10/1998 Podkowa et al. ..... 711/5

OTHER PUBLICATIONS

Motorola Single Chip Microcomputer Data, "MC146818," 1984, pp. 3–996 through 3–1015.

Dallas Semiconductor DS1685/DS1687 3 Volt/5 Volt Real Time Clock, pp. 116–137, 1995.

*Primary Examiner*—Vit Miska

*Attorney, Agent, or Firm*—Finnegan, Henderson, Farabow, Garrett & Dunner, L.L.P.

[57] ABSTRACT

A register group (REG) is constructed by a register for calendar data of year, month, date, hour, minute and second, a data register constructed by an empty area, for storing alarm time of month, date, hour, minute and second, and a register for controlling generation of various interrupts. A comparator compares calendar information of month, date, hour, minute and second of the present time with month, date, hour, minute and second of set alarm time and an interrupt is generated when the compared values coincide with each other.

7 Claims, 9 Drawing Sheets

| | |
|---|---|
| INDEX 0 | SECOND COUNTER (R/W) |
| 1 | SECOND ALARM (R/W) |
| 2 | MINUTE COUNTER (R/W) |
| 3 | MINUTE ALARM (R/W) |
| 4 | HOUR COUNTER (R/W) |
| 5 | HOUR ALARM (R/W) |
| 6 | DAY-OF-THE-WEEK REGISTER (R/W) |
| 7 | DAY COUNTER (R/W) |
| 8 | MONTH COUNTER (R/W) |
| 9 | YEAR COUNTER (R/W) |
| A | CONTROL REGISTER A (R/W)···INTERNAL TIMER CONTROL |
| B | CONTROL REGISTER B (R/W)···INTERRUPT/COUNT CONTROL) |
| C | CONTROL REGISTER C (R)···INTERRUPT STATUS |
| D | CONTROL REGISTER D (R)···RTC STATUS |
| E~7F | GENERAL PURPOSE RAM (R/W) |

FIG. 2 (PRIOR ART)

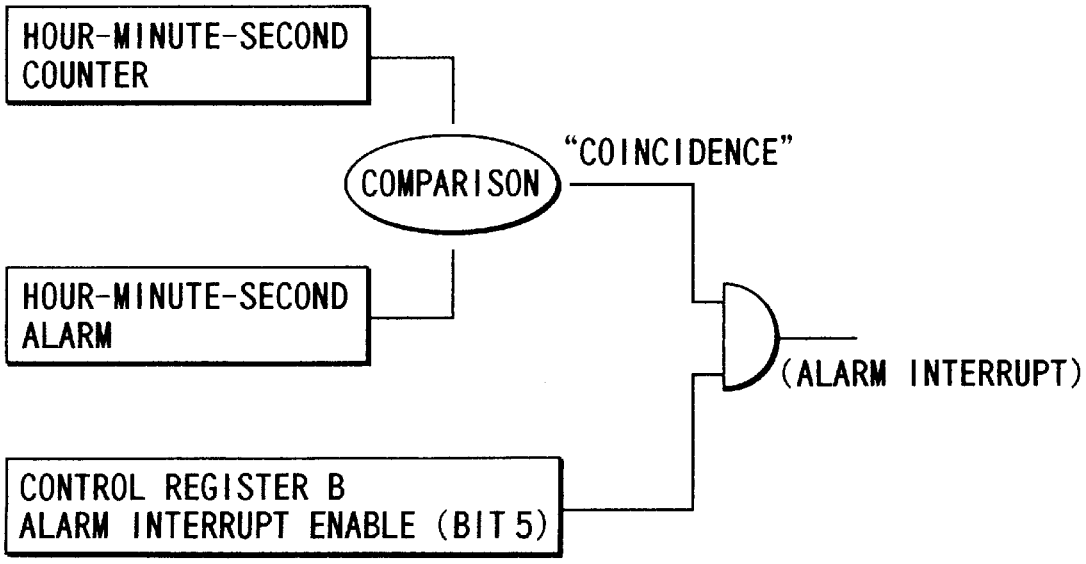

FIG. 3 (PRIOR ART)

REAL-TIME CLOCK DEVICE SUITABLE FOR PORTABLE COMPUTER HAVING AUTO POWER-ON FUNCTION

BACKGROUND OF THE INVENTION

This invention relates to a real-time clock device suitable for a personal computer or the like having an alarm power-on function for automatically turning on the power source at specified time, for example.

Recently, various types of small-sized and high-performance personal computers are developed. In most of the above types of personal computers, for example, the power source switch is not directly operated by the user and an alarm power-on function for automatically turning on the system power source at the power-on time which is previously specified is provided.

By using the alarm power-on function, the system operation can be started at desired time without any attended operator, and therefore, it becomes possible to construct a system operation environment for automatically starting the server at the starting time of work every morning in a case where the personal computer is used as the server of LAN in an office, for example.

The time-base system management is realized by causing a real-time clock provided in the personal computer to generate an alarm interrupt.

The real-time clock (RTC) is a timepiece module having an independent battery for operation and has a backup RAM always supplied with electric power from the battery. The backup RAM is called an RTC memory and used for storing environment setting information which indicates the system operation environment including power-on time, for example.

The setting/changing of the environment setting information is effected on the setup screen provided by the application program executed and controlled by a CPU. One example of the setup screen is shown in FIG. 1.

As shown in FIG. 1, on the setup screen, an environment setting item 60 for starting the alarm power-on function is included.

In the environment setting item 60 of the alarm power-on function, it is possible to specify the enable (use)/disable (non-use) state of the alarm power-on function, and when the alarm power-on function is set in the enable state, it becomes further possible to specify the operation time thereof.

In FIG. 2, the construction of a register in a timepiece information storing area of the backup RAM provided in the real-time clock is shown. The alarm interrupt generating information items (hour, minute, second) set for realizing the alarm power-on function and specified on the setup screen shown in FIG. 1 are stored as alarm information in an hour alarm register, minute alarm register and second alarm register, respectively. Further, specification of the enable/disable state of the alarm power-on function is stored in a control register B. An hour counter register, minute counter register and second counter register for managing the hour, minute and second of a calendar are registers for counting the present time (hour, minute, second).

In the real-time clock with the above construction, an alarm interrupt is generated based on the operational concept shown in FIG. 3. That is, the hour, minute and second indicated by the respective counter registers are compared with hour, minute and second alarm information items stored in the respective alarm registers, and when the result of comparison indicates coincidence and the specification of the enable/disable state of the alarm interrupt stored in the control register indicates the enable state, the alarm interrupt is generated.

However, in the conventional real-time clock, a register for storing the time (year, month, date) of operation of the alarm power-on function is not provided, and therefore, if it is desired to generate an alarm interrupt on the specified time, it is required to effect a process for managing the alarm month and date by a process in a BIOS (basic input and output system) and comparing the alarm month and date thereof with the month and date indicated by the counter registers in the BIOS.

In order to solve the above problem, U.S. Pat. No. 5,422,862 (Inventor: Michael T. Wisor, filed on May 20, 1994) discloses that registers for setting the month and date of the real-time clock are selectively switched by use of a bit of a register to set the month and date of generation of an alarm. That is, as shown in FIG. 4A, when a port address 07h" is specified and an enable bit is "1", month data for timer counter is set in one register (REG1), and when the enable bit is "0", month data for alarm is set in the other register (REG2). Further, as shown in FIG. 4B, when a port address "08*h*" is specified and the enable bit is "1", date data for timer counter is set in one register (REG3), and when the enable bit is "0", date data for alarm is set in the other register (REG4). As shown in FIG. 4C, when a port address "09*h*" is specified and the enable bit is "1", year data (lower two digits) for timer counter is set in one register (REG5), and when the enable bit is "0", year data (lower two digits) for alarm is set in the other register (REG6).

However, in this case, since it is necessary to set the switching bit (enable bit) for switching between the normal year, month and date registers and the year, month and date registers for alarm, the process for setting the alarm time based on software becomes complicated and the construction of the comparing circuit becomes complicated because of the switching operation.

BRIEF SUMMARY OF THE INVENTION

An object of this invention is to provide a real-time clock device in which the month and date for alarm (or the year, month and date for alarm) can be set by taking it into consideration that not only a timepiece information management area but also an area assigned for storing the other environment setting information is provided in a storage area of a backup RAM provided in a real-time clock and effectively using a empty area of the environment setting information storing area and the month and date for alarm can be easily set not only by a BIOS but also by an OS (operating system) in a simple construction.

In order to attain the above object, according to this invention, a real-time clock system comprises first setting means for setting an enable/disable state of an alarm power-on function; second setting means for setting alarm information containing time information and calendar information for executing the alarm power-on function; a non-volatile memory provided in a real-time clock device and having a first area for storing time information among the set alarm information and a second area for storing the calendar information; a counter for counting initialized calendar information and time information in response to a clock signal; and a comparator for comparing the time information and calendar information from the counter with the time information and calendar information set in the first and second areas of the non-volatile memory and outputting an alarm interrupt signal when the compared information items coincide with each other and if the alarm power-on function is set in the enable state.

According to a second aspect of this invention, an alarm setting method in a real-time clock system comprises the steps of setting the enable/disable state of an alarm power-on function; setting alarm information containing time information and calendar information for executing the alarm power-on function; storing time information among the set alarm information into a first area of a non-volatile memory in a real-time clock device and storing the calendar information into a second area of the non-volatile memory; counting initialized calendar information and time information in response to a clock signal; and comparing the counted time information and calendar information with the time information and calendar information set in the first and second areas of the non-volatile memory and outputting an alarm interrupt signal when the compared information items coincide with each other and if the alarm power-on function is set in the enable state.

According to this invention, the non-volatile memory contained in the real-time clock device has a timepiece information storing area and an environment setting information storing area. In the timepiece information storing area, timepiece information including time counter information used for time management of the computer system and used for specifying the year, month, date, hour, minute and second of the present time and alarm time information for specifying the hour, minute and second of the time at which an alarm is to be generated is set. In the environment setting information storing area, the other environment setting information of the computer system which is different from the above timepiece information is set. In the environment setting information storing area, a storing area for setting alarm month/date information used for specifying the month and date on which an alarm is to be generated is assigned, and information of the alarm generating month, date, hour, minute and second determined based on the alarm month/date information in the environment setting information storing area and the alarm time information in the timepiece information storing area is compared with the time counter information in the timepiece information storing area, and when the compared information items coincide with each other, an alarm interrupt is generated. With this construction, it is possible to provide a real-time clock device capable of setting the month and date for alarm by effectively using an empty area in the environment setting information storing area and easily setting the month and date for alarm not only by BIOS but also by OS in a simple construction.

Additional objects and advantages of the invention will be set forth in the description which follows, and in part will be obvious from the description, or may be learned by practice of the invention. The objects and advantages of the invention may be realized and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIG. 2 is a diagram showing the register construction in a timepiece information storing area of a backup RAM provided in a real-time clock;

FIG. 3 is a diagram showing the operational concept of generation of an alarm interrupt in the real-time clock;

DETAILED DESCRIPTION OF THE INVENTION

There will now be described embodiments of this invention with reference to the accompanying drawings.

Figure 1:
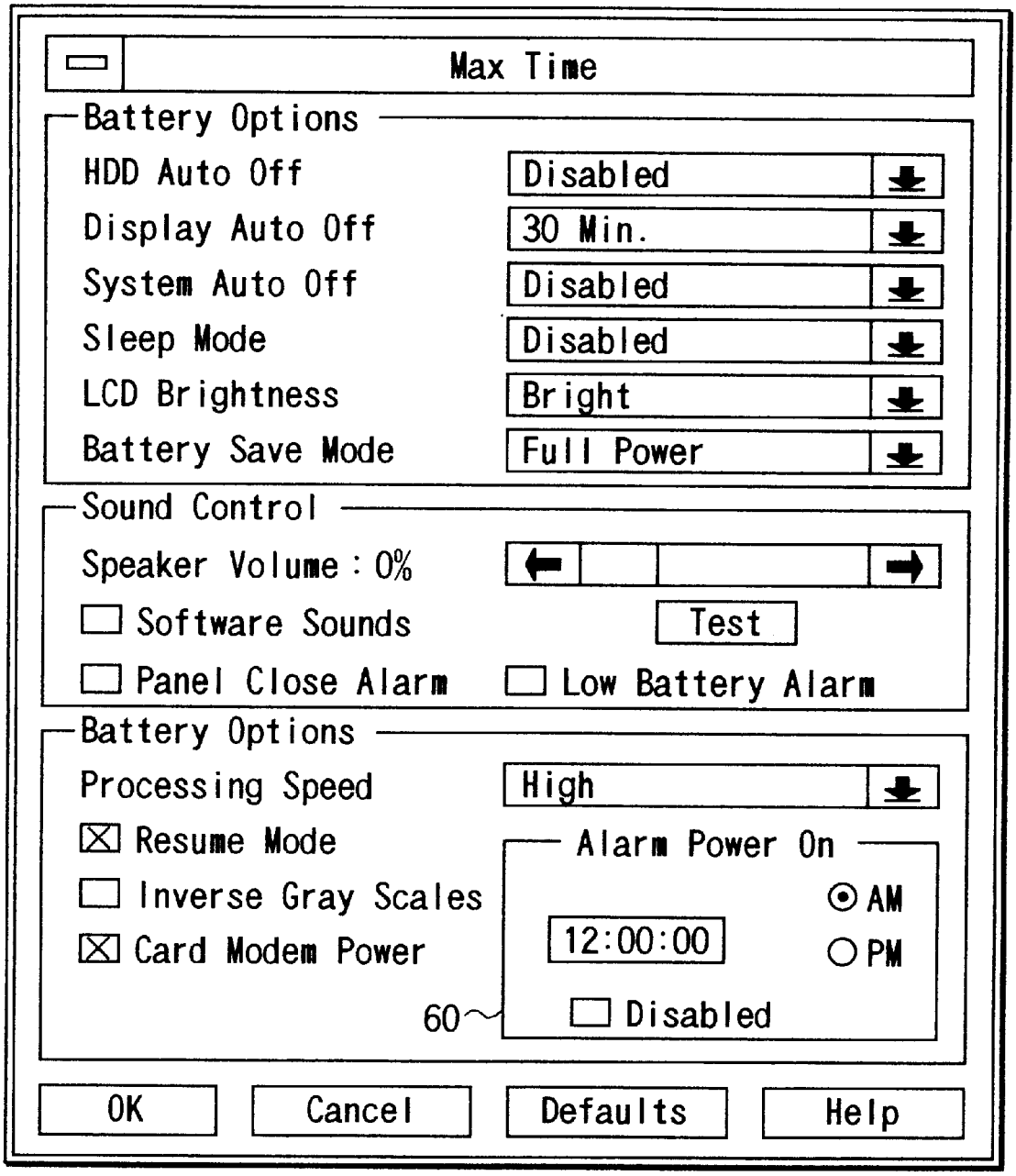
FIG. 1 (PRIOR ART)
FIG. 1 is a view showing one example of the construction of a setup screen having environment setting items for executing the conventional alarm power-on function.
Figure 4A:
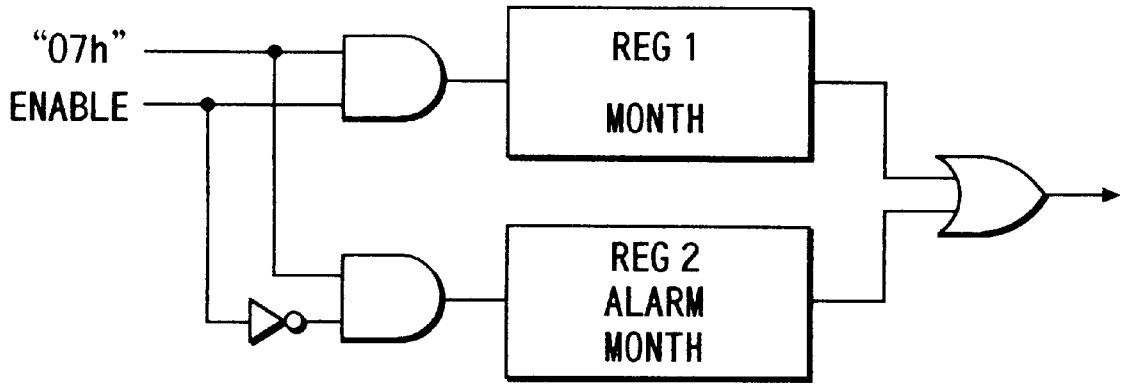
FIGS. 4A to 4C are circuit diagrams showing examples of the construction for setting year, month and date information for alarm in the prior art into a register in RTC.
Figure 4B:
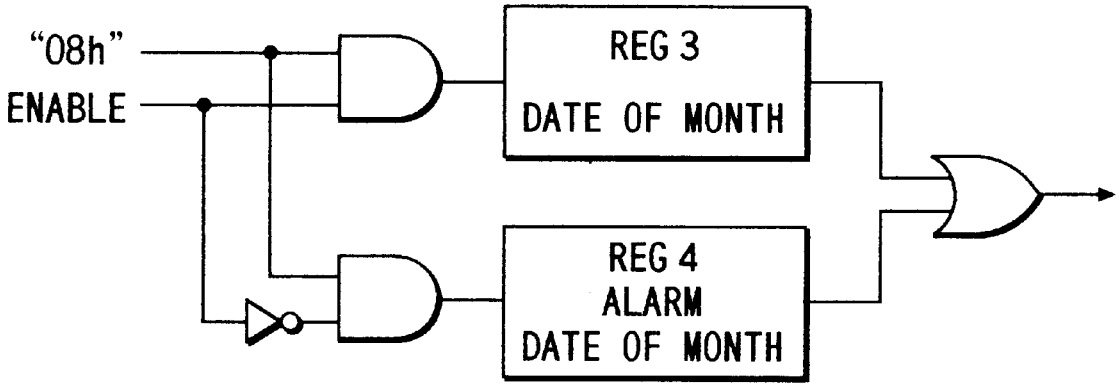
Figure 4C:
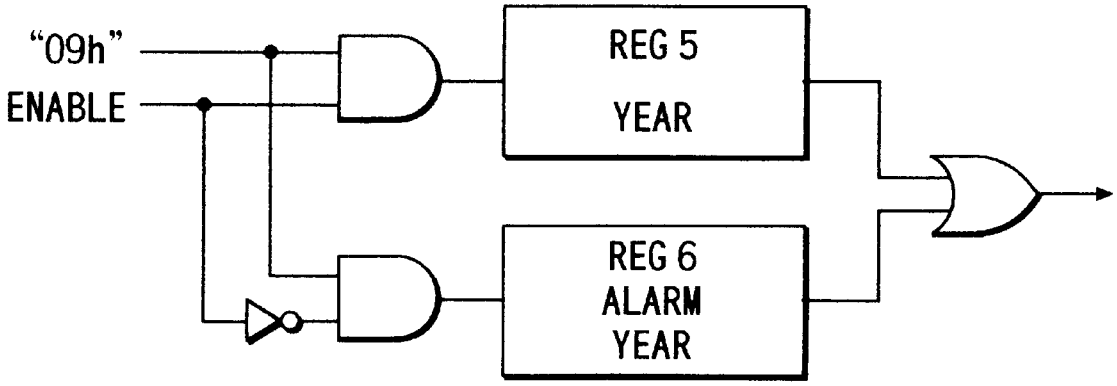
Figure 5:
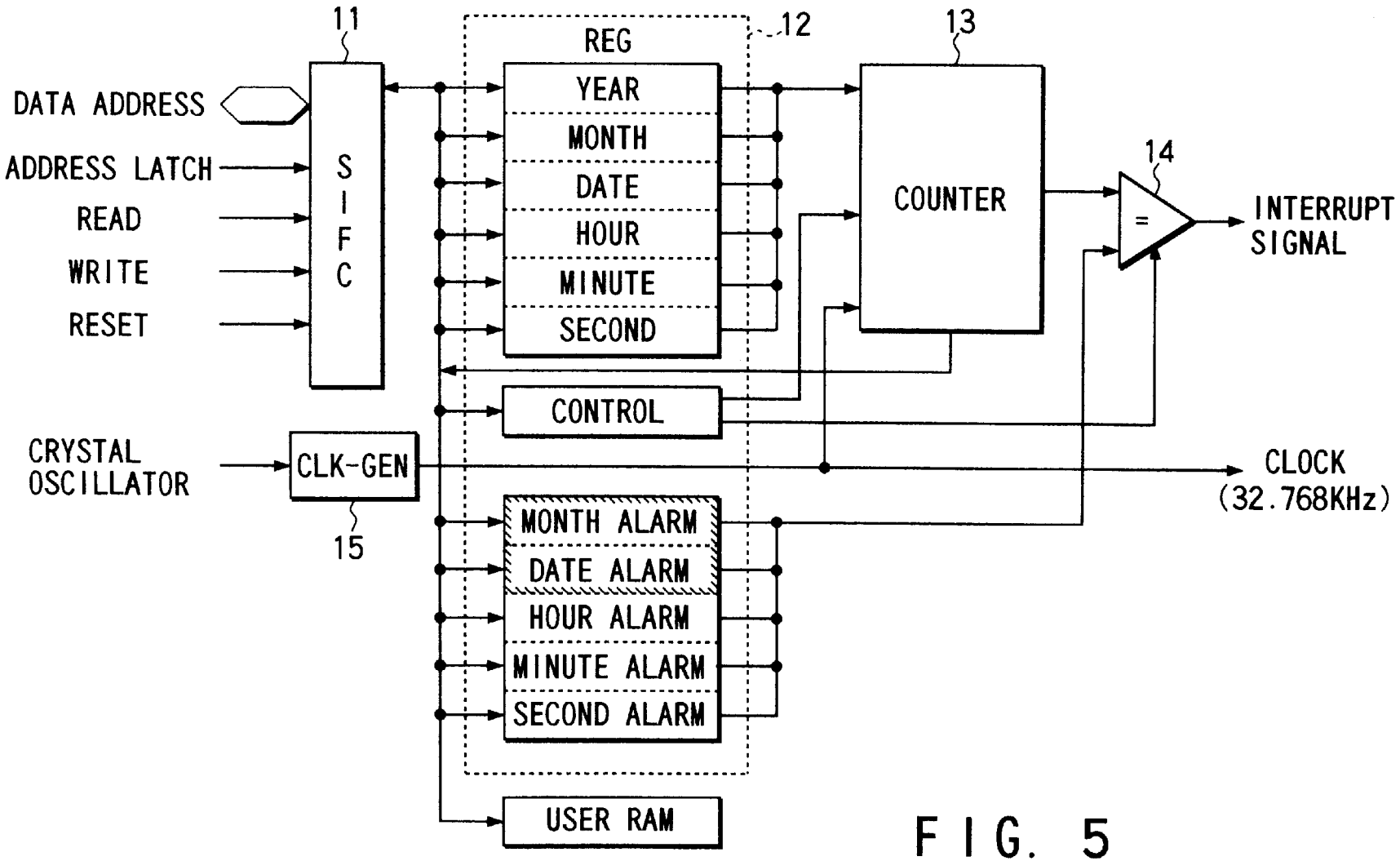
FIG. 5 is a block diagram showing the construction of a main portion in one embodiment of this invention.

FIG. 5 is a block diagram showing the construction of a main portion in one embodiment of this invention.

In FIG. 5, a system interface control circuit (SIFC) 11 acts as an interface between the system CPU and RTC and transmits and receives various types of data items including calendar information and alarm information via data and address buses according to address latch, read, write and reset signals in this example.

A register group (REG) 12 stores calendar information and alarm information. A counter 13 is used for timer counting. A comparator 14 is used for controlling an alarm. A clock generator (CLK-GEN) 15 creates a time counting clock.

The system interface control circuit (SIFC) 11 permits the operation of reading and writing data of calendar information and alarm information to be effected between the system CPU and the registers of the register group (REG) 12.

The register group (REG) 12 includes a register for calendar data of year, month, date, hour, minute and second, a data register for alarm time of month, date, hour, minute and second, and a control register for controlling generation of various interrupts.

The counter 13 effects the counting operation for automatically updating time data from the initialized calendar in response to a time counting clock created by the clock generator (CLK-GEN).

The comparator 14 compares the present calendar data with alarm time and generates an interrupt when the compared time data items coincide with each other.

Figure 6:
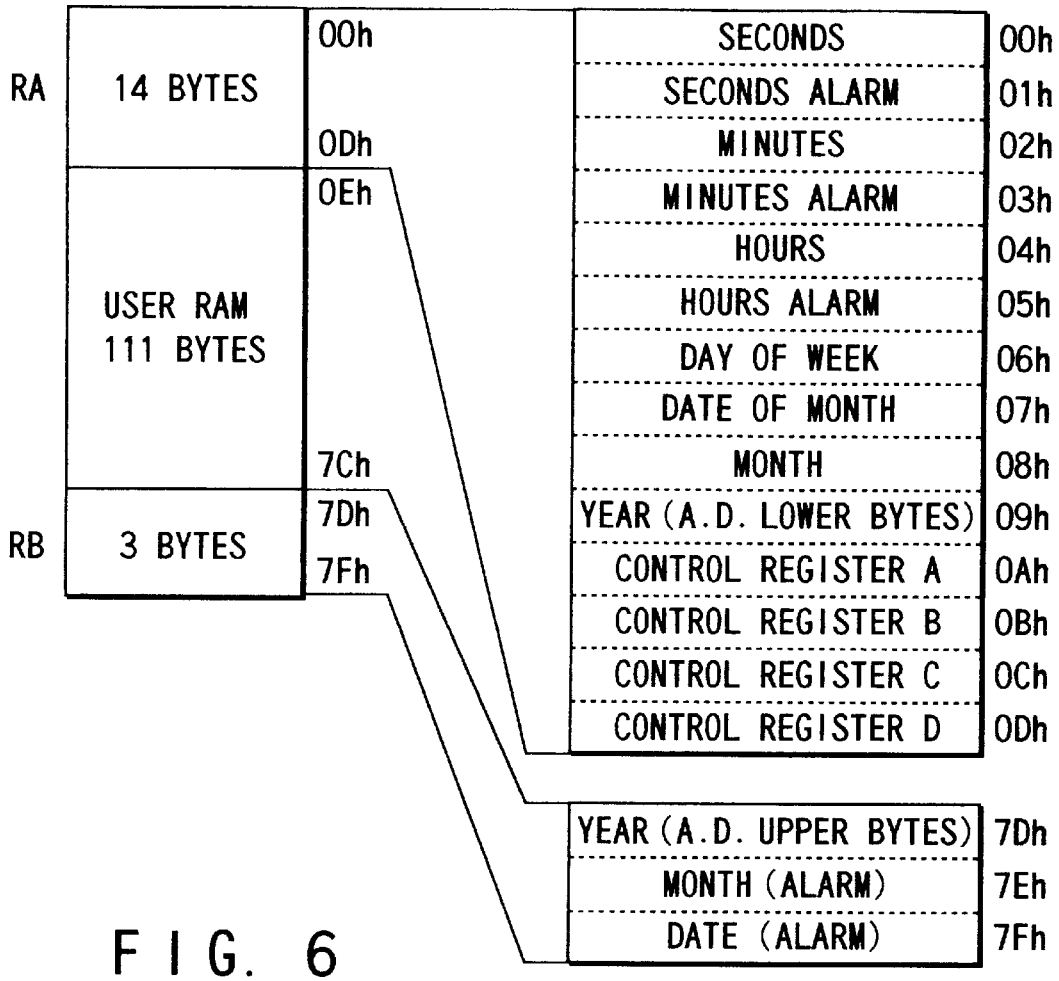
FIG. 6 is a diagram showing an address map of a register group (REG) in the above embodiment.

The register group (REG) 12 is mapped as shown by an address map of FIG. 6. In this example, since the calendar register and the alarm time register are separately provided, alarm time can be set directly from OS. Therefore, an alarm wake-up can be easily realized.

In this example, an empty area RB in the RTC memory (backup RAM) area (128 bytes) is used as an alarm time register for alarm time of month and date. That is, in this example, 7E*h* and 7F*h* of the empty area are used as alarm time registers for month and date.

Figure 7:
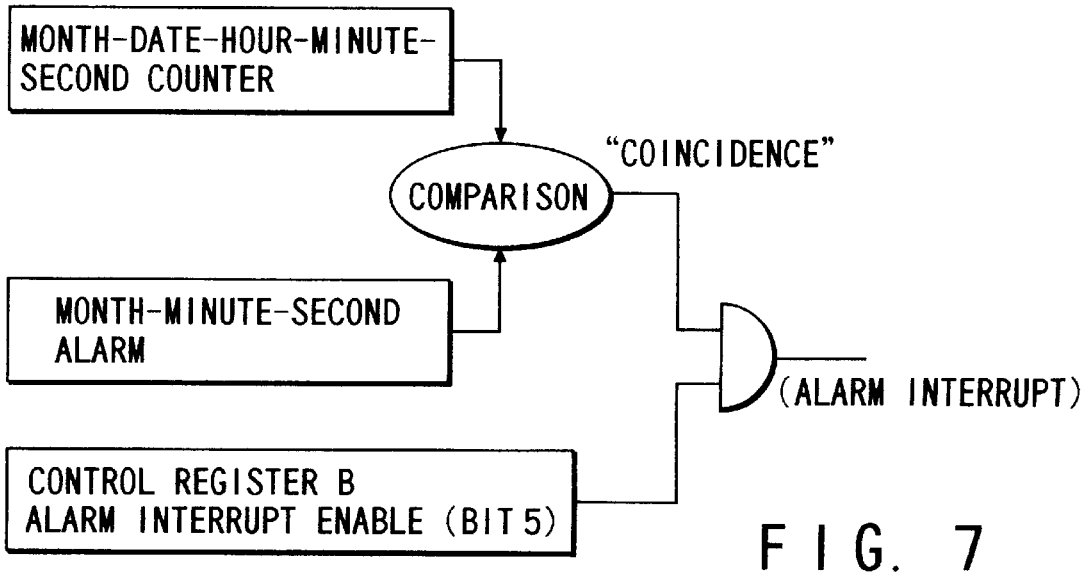
FIG. 7 is a diagram for illustrating the operational concept in the above embodiment.

FIG. 7 is a diagram for illustrating the operational concept in the above embodiment and, for example, time information items of month, date, hour, minute and second respectively obtained by omitting "year" from time counting count values of year, month, date, hour, minute and second stored in the calendar register shown in FIG. 6 and from alarm set values of year, month, date, hour, minute and second stored in the alarm time register are compared with each other, and when the compared time data items of month, date, hour, minute and second coincide with each other and if the alarm interrupt enable bit (bit 5) of the control register B is set, an alarm interrupt is generated.

Now, the operation of the real-time clock device according to one embodiment of this invention is explained with reference to FIGS. 5 to 8.

Figure 8:
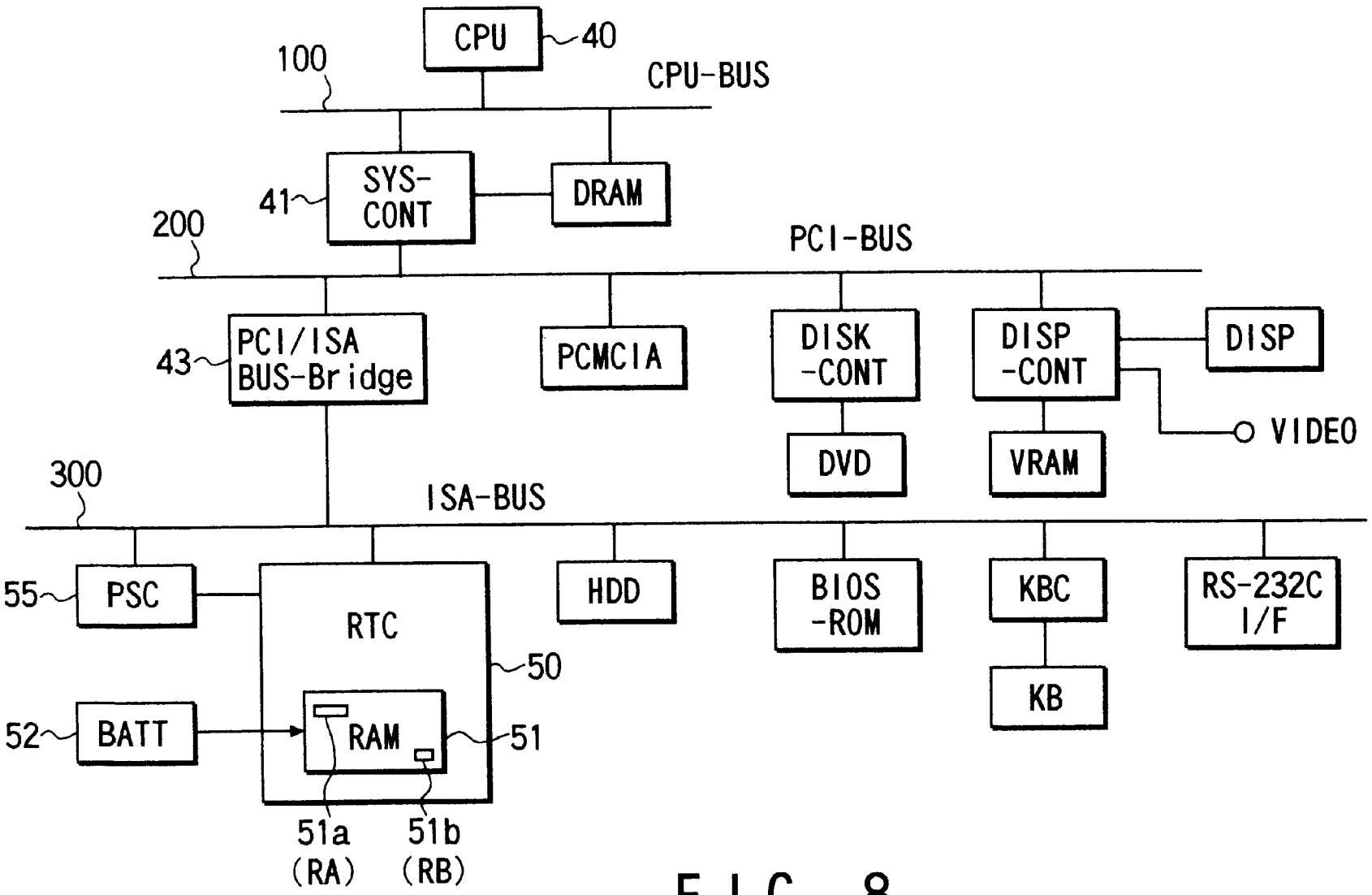
FIG. 8 is a block diagram showing an example of the system construction of a personal computer having a real-time clock device in the above embodiment.

The system interface control circuit (SIFC) 11 transfers various storage data items including calendar information and alarm information via the data and address buses according to transmission and reception of address latch, read, write and reset signals between a system CPU 40 (FIG. 8) and an RTC 50 (FIG. 8).

In this case, when alarm information containing month and date is received from the system, the alarm information is set into the data register for alarm time of month, date, hour, minute and second in the register group (REG) 12.

In FIG. 5, in order to show the construction in a simplified form, alarm time data items of month, date, hour, minute and second in the register group (REG) 12 are collectively shown, but more specifically, the empty area RB in the RTC memory (backup RAM) area (128 bytes) is used as an alarm time register for time data of month and date as shown in FIG. 6. In a more concrete example, 7E*h* and 7F*h* of the empty area are used as alarm time registers for month and date, alarm information of month and date is set in the alarm time registers constructed by the above areas (7E*h*, 7F*h*), and alarm information of hour, minute and second is set in the alarm time registers of areas 05*h*, 03*h*, 01*h* which are conventionally used for storage of alarm time.

When the alarm interrupt enable bit (bit 5) of the control register B is set, the comparator 14 compares the values of the calendar registers in the register group (REG) 12 with the values set in the alarm time registers and generates an interrupt when the calendar information of the present time of month, date, hour, minute and second indicated by the calendar registers in the register group (REG) 12 coincides with the alarm information set in the alarm time registers for each unit value. By this interrupt, for example, the alarm power-on function containing specification of month and date is realized.

When effective values are not set in the alarm time registers (7E*h*, 7F*h*) for month and date and alarm time is set in the other alarm time registers (05*h*, 03*h*, 01*h*), the alarm function of hour, minute and second is executed as in the conventional case.

FIG. 8 is a block diagram showing an example of the system construction of a personal computer having a real-time clock device in the above embodiment.

In this example, the real-time clock device (RTC) 50 according to the embodiment of this invention is provided on an ISA bus 300 and is connected to interface with the CPU 40 which effects the system control via a PCI-ISA bus bridge (PCI-ISA BUS-Bridge) 43, PCI bus 200, system controller 41 and the like.

An RTC memory (backup RAM) 51 of the real-time clock device (RTC) 50 continuously effects the memory operation by use of an exclusive backup battery (BAT) 52 irrespective of the ON/OFF state of the system power source.

As shown in FIG. 6, the RTC memory (backup RAM) 51 is constructed by 128 bytes, alarm information of hour, minute and second is set in an alarm time register (05h, 03h, 01h) provided in an area (00h to 0Dh) 51*a* of 14 bytes among the above 128 bytes as indicated by a reference symbol RA in FIG. 6 and alarm information of month and date is set in an alarm time register (7E*h*, 7F*h*) 51*b* using a 2-byte area which is conventionally treated as an empty area and indicated by a reference symbol RB.

The real-time clock device (RTC) 50 generates and inputs an alarm interrupt to a power source control microprocessor (PSC) 55 if the alarm time coincides with the present time and when the alarm power-on function is set in the enable state. The power source control microprocessor (PSC) 55 is always set in the operative state irrespective of the ON/OFF position of the system power source switch and turns on the system power source to automatically set the system into the operative state when it receives the alarm interrupt from the real-time clock device (RTC) 50.

Figure 9:
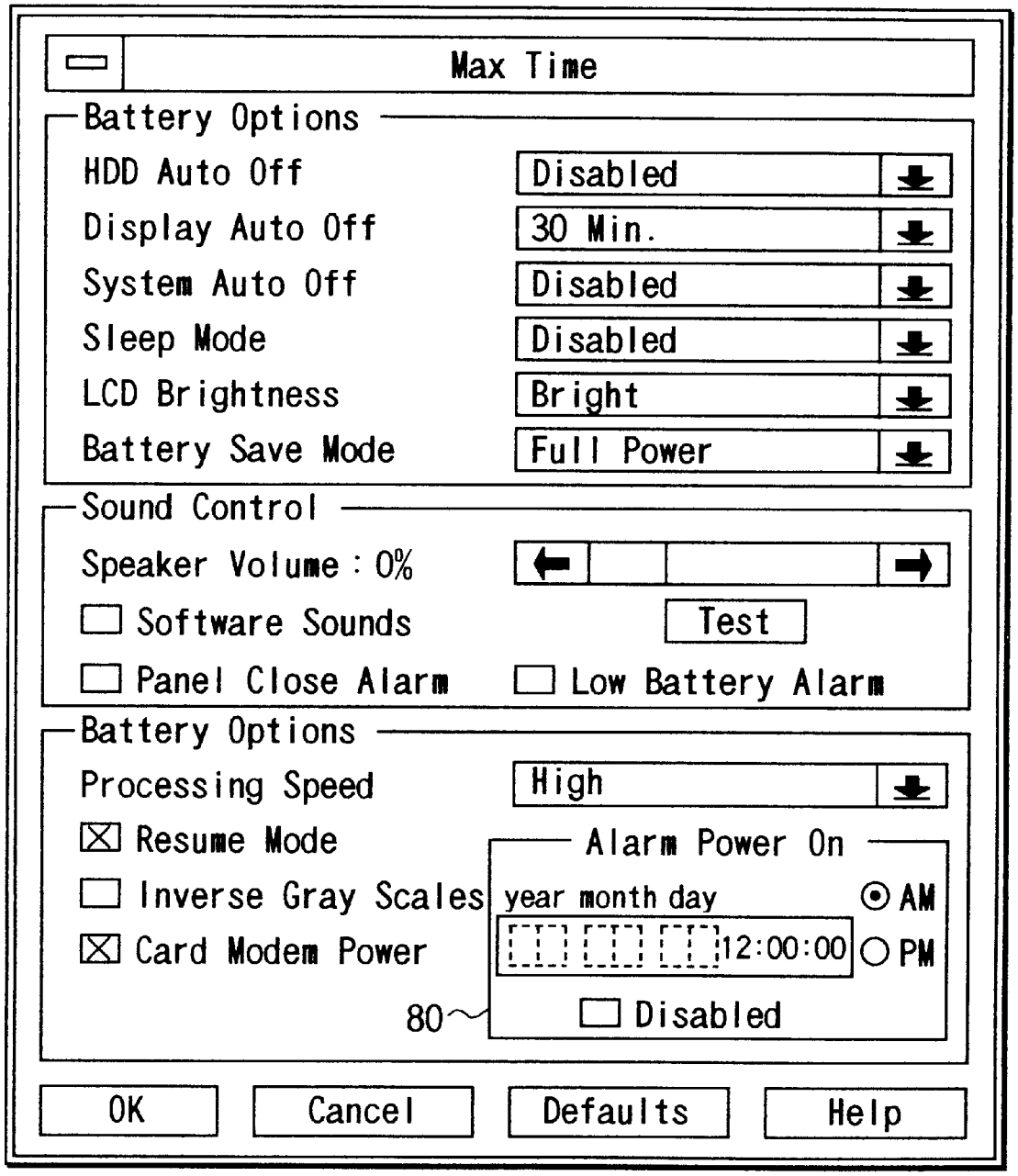
FIG. 9 is a view showing an example of a setup screen in the above embodiment.

FIG. 9 is a view showing an example of a setup screen in the above embodiment and an environment setting item 80 for executing the alarm power-on function is set on the setup screen.

In the environment setting item 80 of the alarm power-on function, the enable (use)/disable (non-use) state of the alarm power-on function can be specified, and when the alarm power-on function is set in the enable state, it becomes possible to specify the operation time thereof including "YEAR", "MONTH", "DAY".

Next, the operation of the real-time clock device (RTC) 50 on the system with the above construction is explained.

In the environment setting item 80 on the setup screen as shown in FIG. 9 at the time of starting of the system operation, the enable state of the alarm power-on function is specified, the operation time thereof including "YEAR", "MONTH", "DAY" is specified, and the alarm power-on operation of the specified month, date and hour, minute, second is started (in the case of alarm power-on, year information is not compared).

In this case, the set alarm setting values are set into the alarm time registers provided in the RTC memory (backup RAM) 51 of the real-time clock device (RTC) 50 via the PCI bus 200 and ISA bus 300 under the control of the CPU 40.

That is, alarm information of hour, minute, second among the set alarm setting values is set into a previously determined alarm time register (05*h*, 03*h*, 01*h*) in the 14-byte area (00*h* to 0D*h*) indicated by the reference symbol RA in FIG. 6 and arranged in the RTC memory (backup RAM) 51 provided in the real-time clock device (RTC) 50 as in the conventional case, and alarm information of "month" and "date" is set into the alarm time register (7E*h*, 7F*h*) 51*b* using register area which are conventionally treated as empty areas and indicated by the reference symbol RB in FIG. 6 in the RTC memory (backup RAM) 51.

Specification of the "enable" state of the alarm power-on function set on the setup screen is reflected on the control register B in the RTC memory (backup RAM) 51 and the alarm interrupt enable bit (bit 5) of the control register B is set to a value (for example, "1") indicating the enable state.

The alarm time of month, date, hour, minute, second set in the alarm time registers 51*a*, 51*b* is compared for alarm checking each time the content of the calendar register (08*h*, 07*h*, 04*h*, 02*h*, 00*h*) shown in FIG. 6 for counting the present time is updated (incremented) when the alarm interrupt enable bit (bit 5) of the control register B is set to a value indicating the enable state. In this case, if the alarm time set in the alarm time registers 51*a*, 51*b* coincides with the present time indicated by the calendar register (08h, 07h, 04h, 02h, 00h), an alarm interrupt is generated from the real-time clock device (RTC) 50.

The alarm interrupt is input to the power source control microprocessor (PSC) 55 when the alarm power-on function is set in the enable state. The power source control microprocessor (PSC) 55 turns on the system power source to automatically set the system into the operative state when it receives the alarm interrupt from the real-time clock device (RTC) 50.

Thus, since month and date for alarm can be set by effectively using the empty area of the environment setting information storing area, the alarm power-on function can be realized in a simple construction.

Further, since calendar information and alarm information can be separately set in different registers, month and date for alarm can be easily set not only by BIOS but also by OS.

The hardware construction in the above embodiment is shown only as one example of a system to which the real-time clock device according to this invention is applied and, for example, this invention can be easily applied to information of schedule management other than the alarm power-on function on various systems such as a portable type information processing unit with other bus construction.

Further, in the above embodiment, the alarm function for time information including month and date is explained as an example, but the alarm function in which time information including year and day of the week can be set can be easily realized by using another empty area (for example, an empty area included in a 111-byte user RAM shown in FIG. 6) in the RTC memory (backup RAM) 51, for example.

Figure 10:
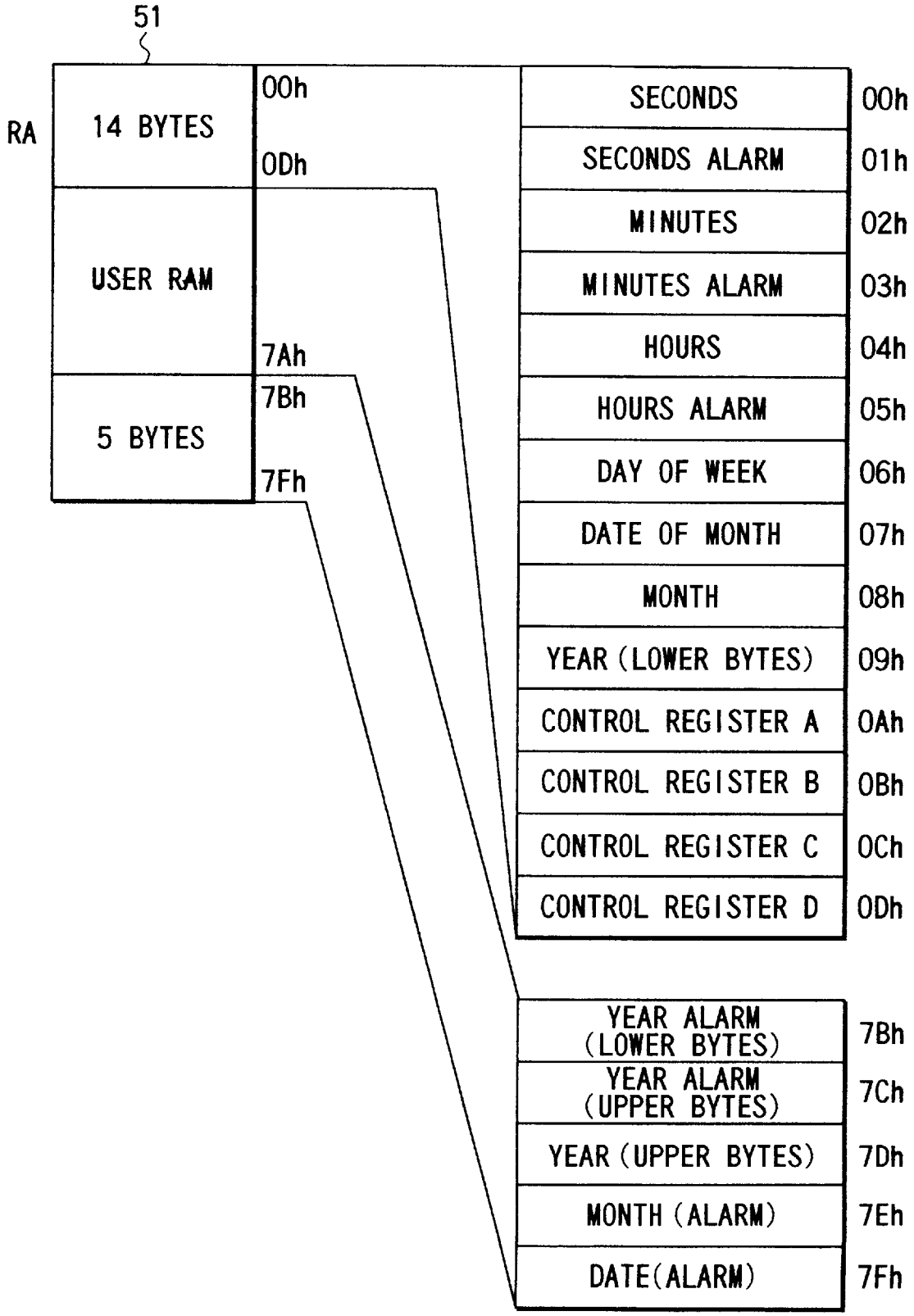
FIG. 10 is a diagram showing an address map of an RTC memory in a case where year, month and date information for timer counter and year, month and date information for alarm are stored into an empty area of the RTC memory in another embodiment of this invention.
Figure 11:
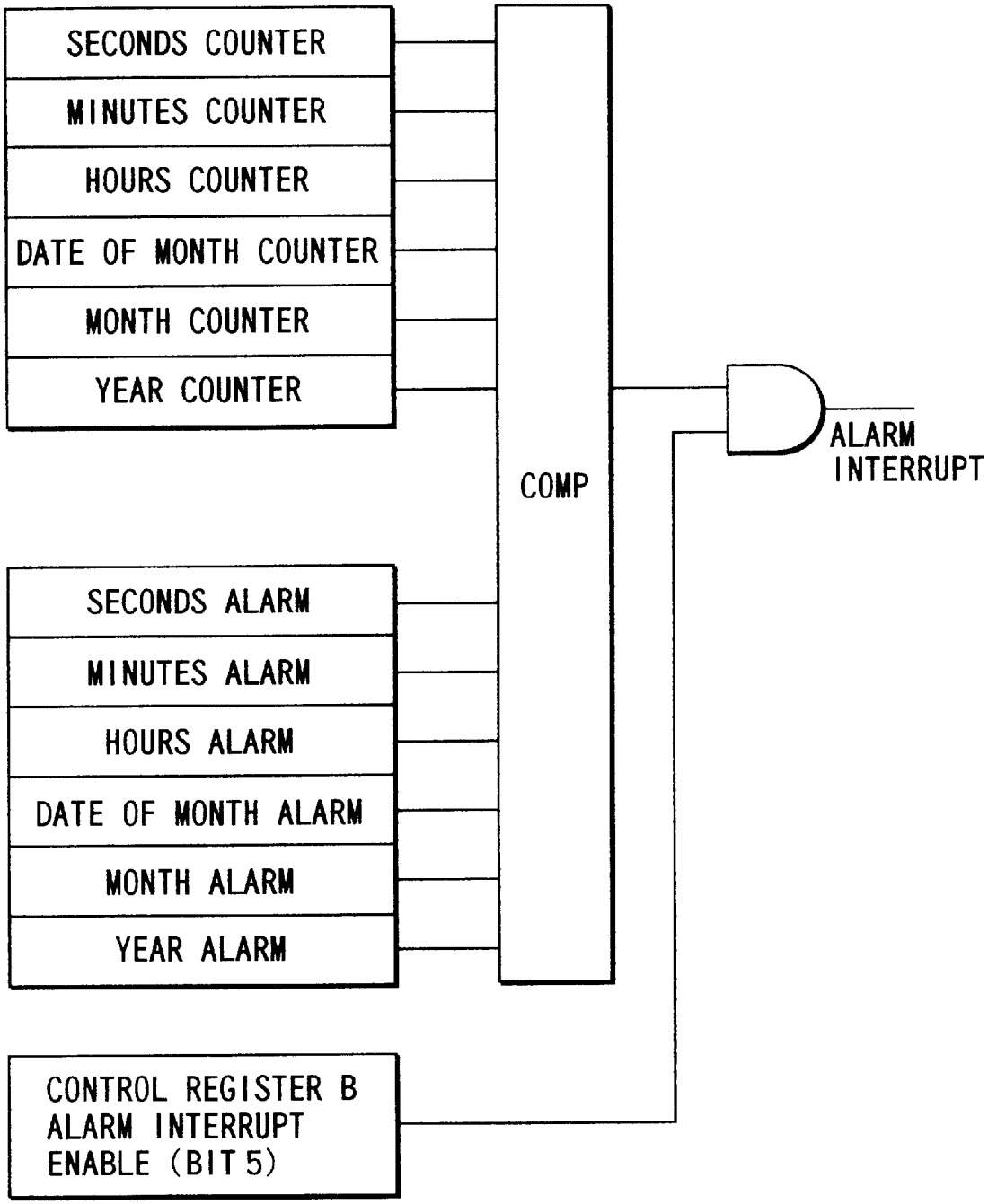
FIG. 11 is a circuit diagram for outputting an alarm interrupt signal according to the result of comparison between the year, month and date information for timer counter and the year, month and date information for alarm in the embodiment shown in FIG. 10.

FIGS. 10 and 11 are diagrams showing another embodiment of this invention. In this embodiment, year information for alarm is stored in an empty area of the RTC memory. That is, lower-digit data of the year information for alarm is held in an address port 7B*h* and upper-digit data of the year information for alarm is held in an address port 7C*h*. Then, as shown in FIG. 11, a comparator is designed to compare year, month, date, hour, minute, second from a timer counter with year, month, date, hour, minute, second for alarm and generate an alarm interrupt signal when the compared time information items coincide with each other. With this design, for example, it becomes possible to solve a problem which may be caused in A.D. 2000 since only the lower digits of the year of the Christian Era are held in the register in the prior art. That is, in business applications, if only two lower digits of the year of the Christian Era are held, it is impossible to distinguish 2000 from 1900, and as a result, an error in the date-sequence process, inverted result of comparison of dates, error in period calculation, error in the processing for an account book or slips on business transactions, erroneous setting of the final date of the validity time and the like may occur and serious problems will occur in the production operations and business transactions. Further, in the practical use of computers, when A.D. 2000 comes, the date of creation of files and data bases is determined as a date in the year of 1900 if only the lower two digits of the year of the Christian Era is held, and there is a strong possibility that an automatic erasing program is executed to instantly erase data which is newly created. According to this invention, when A.D. 2000 comes, the above problem will not occur.

Additional advantages and modifications will readily occur to those skilled in the art. Therefore, the invention in its broader aspects is not limited to the specific details and representative embodiments shown and described herein. Accordingly, various modifications may be made without departing from the spirit of scope of the general inventive concept as defined by the appended claims and their equivalents.

What is claimed is:

1. A real-time clock device comprising:

a non-volatile memory including a timepiece information storing area containing timepiece information including time counter information used for time management of a computer system and used for specifying the year, month, date, hour, minute and second of the present time, and alarm time information for specifying the hour, minute and second of the time at which an alarm is generated is set, and an environment setting information storing area containing environment setting information and a month/date storing area for setting alarm month and date information used for specifying the month and date on which an alarm is generated, wherein said month/date storing area is assigned to an address different from an address of the timepiece information storing area; and a section for comparing the alarm generating month, date, hour, minute and second determined based on the alarm month and date information in said environment setting information storing area and the alarm time information in said timepiece information storing area with the time counter information in said timepiece information storing area and generating an alarm interrupt when the compared information items coincide with each other.

2. The device according to claim 1, wherein the year of the time counter information is constructed by information indicating the lower two digits of the year of the Christian Era and information indicating the upper two digits thereof is stored in part of said environment setting information storing area.

3. An alarm setting method in a real-time clock device having a non-volatile memory including a timepiece information storing area and an environment setting information storing area, wherein the timepiece information storing area has timepiece information including time counter information used for time management of a computer system and used for specifying the year, month, date, hour, minute and second of the present time and alarm time information for specifying the hour, minute and second of the time at which an alarm is generated is set and the environment setting information storing area has the other environment setting information of the computer system which is different from the timepiece information, the alarm setting method comprising:

using a specified empty area, assigned to an address which is different from an address of the timepiece information storing area, present in said environment setting information storing area of said non-volatile memory as an area for setting month and date for alarm; and setting the month and date for alarm by use of BIOS or OS.

4. A real-time clock system comprising:

a first setting section for setting an enable/disable state of an alarm power-on function;

a second setting section for setting alarm information containing time information and calendar information for executing the alarm power-on function;

a non-volatile memory provided in a real-time clock device and having a first area for storing time information including hour, minute and second set alarm information and a second area for storing the calendar information including month and date set alarm information, wherein the first area is assigned to an address which is different from an address of the second area;

a counter for counting initialized calendar information and time information in response to a clock signal; and a comparator for comparing the time information and calendar information from said counter with the time information and calendar information set in said first and second areas of said non-volatile memory and outputting an alarm interrupt signal when the compared information items coincide with each other and if the alarm power-on function is set in the enable state.

5. The system according to claim 4, wherein the calendar information is constructed by data of the year of the Christian Era, month and date and said second area further includes an area for storing upper-digit data of the year of the Christian Era.

6. An alarm setting method in a real-time clock system comprising:

setting the enable/disable state of an alarm power-on function;

setting alarm information containing time information date and month information for executing the alarm power-on function;

storing time information among the set alarm information into a first area of a non-volatile memory in a real-time clock device and storing the date and month information into a second area of the non-volatile memory, the first area being assigned to an address which is different from an address of the second area;

counting initialized calendar information and time information in response to a clock signal; and comparing the counted time information and calendar information with the time information and calendar information set in the first and second areas of the non-volatile memory and outputting an alarm interrupt signal when the compared information items coincide with each other and if the alarm power-on function is set in the enable state.

7. The method according to claim 6, wherein the calendar information is constructed by data of the year of the Christian Era, month and date, lower-digit data of the year of the Christian Era is stored in the first area of the non-volatile memory and upper-digit data of the year of the Christian Era is stored in the second area.

* * * * *

UNITED STATES PATENT AND TRADEMARK OFFICE

CERTIFICATE OF CORRECTION

PATENT NO. : 6,134,187
DATED : October 17,2000
INVENTOR(S) : Yuichi Tomiyasu

It is certified that error appears in the above-identified patent and that said Letters Patent is hereby corrected as shown below:

Column 10,
Lines 5-6, "information date and" should read -- information, date, and --.

Signed and Sealed this

Fourth Day of February, 2003

JAMES E. ROGAN
*Director of the United States Patent and Trademark Office*